US011326844B2

(12) United States Patent
Ferguson et al.

(10) Patent No.: US 11,326,844 B2
(45) Date of Patent: May 10, 2022

(54) HEAT EXCHANGER INTEGRATED SERVICES

(71) Applicant: Amerapex NDT LLC, Houston, TX (US)

(72) Inventors: John Ferguson, Houston, TX (US); Deric Puckitt, Houston, TX (US); Steven Christopher, Manvel, TX (US); William Parker, Manvel, TX (US)

(73) Assignee: Amerapex NDT LLC, Houston, TX (US)

( * ) Notice: Subject to any disclaimer, the term of this patent is extended or adjusted under 35 U.S.C. 154(b) by 162 days.

(21) Appl. No.: 16/851,579

(22) Filed: Apr. 17, 2020

(65) Prior Publication Data

US 2020/0333093 A1 Oct. 22, 2020

Related U.S. Application Data

(60) Provisional application No. 62/835,959, filed on Apr. 18, 2019.

(51) Int. Cl.

| | |
|---|---|
| ***F28G 15/00*** | (2006.01) |
| ***F28G 15/08*** | (2006.01) |
| ***F28G 15/04*** | (2006.01) |
| ***F28G 9/00*** | (2006.01) |
| *B08B 9/02* | (2006.01) |
| *B08B 9/04* | (2006.01) |
| *B08B 9/027* | (2006.01) |
| *B08B 9/043* | (2006.01) |
| *B24C 3/32* | (2006.01) |

(52) U.S. Cl.

CPC ..... *F28G 15/003* (2013.01); *F28G 9/00* (2013.01); *F28G 15/04* (2013.01); *F28G 15/08* (2013.01); *B08B 9/02* (2013.01); *B08B 9/021* (2013.01); *B08B 9/027* (2013.01); *B08B 9/04* (2013.01); *B08B 9/043* (2013.01); *B24C 3/325* (2013.01)

(58) Field of Classification Search

CPC ..... F28G 15/003; F28G 15/04; F28G 15/08; F28G 9/00; F16L 55/46; F16L 55/48; B08B 9/02; B08B 9/043; B08B 9/049; B08B 9/027; B08B 9/021; B24C 3/325

See application file for complete search history.

(56) References Cited

U.S. PATENT DOCUMENTS 4,135,534 A 1/1979 Autelli
4,424,769 A * 1/1984 Charamathieu ..... F28G 15/04 122/392
5,265,129 A * 11/1993 Brooks ..... F22B 37/002 376/245

(Continued)

*Primary Examiner* — Jenna M Hopkins
(74) *Attorney, Agent, or Firm* — Norton Rose Fulbright US LLP

(57) ABSTRACT

An apparatus for cleaning heat exchangers may include a cleaning lance for cleaning a plurality of bores of the heat exchanger and an examination lance for examining a plurality of bores of the heat exchanger. The apparatus may further include a first feeder configured to extend and retract the cleaning lance and a second feeder configured to extend and retract the examination lance. The apparatus may further include a controller configured to control the first feeder to feed the cleaning lance into a first bore, to control the cleaning lance to clean the first bore, and to control the first feeder to retract the cleaning lance from the first bore.

20 Claims, 9 Drawing Sheets

(56) References Cited

U.S. PATENT DOCUMENTS

| | | | | |
|---|---|---|---|---|
| 6,681,839 | B1 * | 1/2004 | Balzer | F28G 1/163 122/379 |
| 9,062,921 | B2 * | 6/2015 | Gromes, Sr. | F28G 15/003 |
| 9,200,490 | B2 * | 12/2015 | Thomas | G01N 33/00 |
| 9,724,737 | B2 * | 8/2017 | Thomas | B08B 9/043 |
| 9,844,803 | B1 * | 12/2017 | Carter | B08B 9/04 |
| 9,851,164 | B2 * | 12/2017 | Hand | F28G 1/163 |
| 10,016,793 | B2 * | 7/2018 | Thomas | B65G 47/14 |
| 10,174,564 | B1 * | 1/2019 | Carter | B08B 9/049 |
| 10,401,878 | B2 * | 9/2019 | Gromes, Sr. | G06F 3/04886 |
| 10,408,552 | B2 * | 9/2019 | Gromes, Sr. | F28G 15/003 |
| 10,514,217 | B2 * | 12/2019 | Wall | F28G 1/163 |
| 10,890,390 | B2 * | 1/2021 | Gromes, Sr. | F28G 15/003 |
| 11,137,103 | B2 * | 10/2021 | Meling | B08B 9/0551 |
| 11,167,328 | B1 * | 11/2021 | Carter | B08B 9/0433 |
| 2009/0211612 | A1 * | 8/2009 | Athanassiu | F28G 15/04 134/54 |
| 2009/0255557 | A1 * | 10/2009 | Gardner | B08B 9/0433 134/18 |
| 2012/0067370 | A1 * | 3/2012 | Crock | F28G 3/163 134/6 |
| 2012/0103368 | A1 | 5/2012 | Gromes, Sr. | |
| 2015/0027499 | A1 * | 1/2015 | Fischer | F22B 37/48 134/18 |
| 2015/0068563 | A1 | 3/2015 | Gzym et al. | |
| 2017/0356702 | A1 | 12/2017 | Gromes, Sr. et al. | |
| 2017/0364096 | A1 * | 12/2017 | Gromes, Sr. | G05D 7/0617 |
| 2018/0313617 | A1 * | 11/2018 | Harris | F28G 3/166 |
| 2019/0039209 | A1 * | 2/2019 | Curran | F28G 1/163 |
| 2020/0132402 | A1 * | 4/2020 | Schneider | F28G 1/163 |
| 2020/0333093 | A1 * | 10/2020 | Ferguson | F28G 15/08 |
| 2020/0391257 | A1 * | 12/2020 | Schneider | B08B 9/04 |
| 2021/0254912 | A1 * | 8/2021 | Stickling | F22B 37/48 |

* cited by examiner

HEAT EXCHANGER INTEGRATED SERVICES

CROSS-REFERENCE TO RELATED APPLICATIONS

This application claims priority to U.S. Provisional Patent Application Ser. No. 62/835,959, filed Apr. 18, 2019, entitled HEAT EXCHANGER INSPECTION SYSTEM, which is incorporated by reference herein in its entirety.

FIELD OF THE DISCLOSURE

The instant disclosure relates to cleaning and examination of heat exchangers. More specifically, portions of this disclosure relate to an integrated system for automation of cleaning and examination of heat exchanger tubes.

BACKGROUND

Many industrial operations, such as oil refining and processing, chemical manufacturing and processing, and other manufacturing operations, generate substantial amounts of heat. Heat exchangers may be installed to cool areas of such operations and avoid overheating. Heat exchangers may include multiple tubes, or bores, through which a medium such as air, coolant, water, or another fluid, is passed to absorb heat from one or more hot areas and transfer the heat to other areas. For example, heat exchangers may include anywhere from two to tens of thousands of tubes for transferring heat. A typically heat exchanger may have as many as 500 bores. Multiple heat exchangers may be installed at refineries and chemical production plants to cool the plants. For example, some facilities may have in excess of 3000 heat exchangers.

Maintenance and examination of heat exchangers can be time consuming and expensive. Heat exchangers may require maintenance, cleaning, and examination at set intervals, such as every five years. In some cases, entire facilities may be shut down for periods of time from one to six weeks for heat exchanger examination and maintenance. Some facilities may stagger heat exchanger examination and maintenance schedules, such that only part of the facility is out of operation while its heat exchangers are examined and maintained, to avoid complete facility shutdown. In some cases, heat exchangers may be inspected and maintained in situ, while in others heat exchangers may be disassembled and moved to an examination yard for examination and maintenance.

Downtime due to heat exchanger examination and maintenance can result in significant costs. Furthermore, examination, cleaning, and maintenance of heat exchangers may require skilled labor, further increasing costs. Cleaning of heat exchangers and examination of heat exchangers may require standby time while transitioning between a team of trained cleaning workers to a team of trained inspection workers, which may further add to costs. Further compounding the costs, additional standby time and rework may be required if an inspection team determines that cleaning work is inadequate, while waiting for the cleaning team to perform additional cleaning. Furthermore, during manual examination, determinations may be made that additional examination and/or cleaning work may be required due to uncovered problems. Such additional examination and/or cleaning may further increase costs. Examination and maintenance work may require the presence of a number of skilled personnel who may be exposed to risks and hazards at the facility.

Shortcomings mentioned here are only representative and are included simply to highlight that a need exists for improved heat exchanger servicing. Embodiments described herein address certain shortcomings but not necessarily each and every one described here or known in the art. Furthermore, embodiments described herein may present other benefits than, and be used in other applications than, those of the shortcomings described above.

SUMMARY

A heat exchanger integrated service system may partially or fully automate both the cleaning and examination of heat exchanger bores in a single process. For example, an apparatus for servicing heat exchangers may include one or more cleaning lances for performing one or more cleaning functions on heat exchanger bores and one or more examination lances for performing one or more examination functions on heat exchanger bores. A controller may control the cleaning lances to clean the one or more bores, such as performing water jet cleaning and subsequent drying operations on the interior of the bores, and may then control one or more examination lances to examine the cleaned bores, such as video recording and non-destructive testing, in a single unified process. When cleaning and examining heat exchangers having multiple bores, a heat exchanger integrated service system may allow examination of some bores contemporaneously with cleaning of other bores. Such a system may reduce facility downtime by increasing the rate at which bores are cleaned and/or examined. Furthermore, such a system may reduce or eliminate rework by allowing for adjustment of cleaning techniques if examination lances determine that cleaning techniques currently being implemented are insufficient. Such a system may also reduce a need for expansion of contracts by allowing for collection of data for analysis as a cleaning and examination process is in progress. Furthermore, such a system may allow a single crew to perform both cleaning and examination, instead of separate crews for each, reducing personnel costs and exposure of personnel to risks and hazards. Such a system may also allow greater flexibility in bore cleaning and examination, allowing for navigation around items such as mechanical plugs, gasket lines, beginning and ends of rows of bores, and low tube count rows.

An apparatus for cleaning and examination of heat exchangers may include a cleaning lance for cleaning a plurality of bores of the heat exchanger and an examination lance for examining the plurality of bores of the heat exchanger. The cleaning lance may, for example, be a water jetting lance or an air-dry lance. The examination lance may, for example, include a video borescope for video analysis of the bores or a non-destructive testing probe.

A first feeder may be configured to extend the cleaning lance into and contract the cleaning lance from the bores of the heat exchanger. For example, the first feeder may be attached to the cleaning lance. A second feeder may be configured to extend the examination lance into and contract the examination lance from the bores of the heat exchanger.

The apparatus may also include a controller for controlling the lances and feeders. For example, the controller may be configured to control the first feeder to extend the cleaning lance into a first bore of the heat exchanger. The controller may then control the cleaning lance to clean the first bore. The controller may then control the first feeder to retract the cleaning lance from the first bore. The controller may then control the second feeder to extend the examination lance into the first bore. The controller may then control the examination lance to examine the first bore. The controller may then control the second feeder to retract the examination lance from the first bore.

The apparatus may also include a pump connected to the cleaning lance to pump a fluid, such as water or air, through the cleaning lance. Controlling the cleaning lance to clean the first bore may include controlling the pump to pump fluid through the cleaning lance. In some embodiments, a safety valve may be coupled between the first pump and the cleaning lance to prevent water from flowing through the cleaning lance when the cleaning lance is not in position. For example, the controller may open the safety valve to allow fluid to flow to the cleaning lance only after the cleaning lance is extended into a bore and may close the safety valve before the cleaning lance is retracted from the bore. Such valves may enhance the safety of personnel operating the system by preventing the cleaning lance from spraying water or another cleaning fluid when the cleaning lance is not inserted into a bore for cleaning. In some cases, a compressor may be connected to a cleaning lance. For example, a system for heat exchanger examination and cleaning may include both a water jet cleaning lance and an air-dry cleaning lance. An air compressor may be connected to the air-dry cleaning lance, and the air-dry cleaning lance may be inserted into bores after the water jet cleaning lance to dry the bores before examination.

The apparatus may also include an indexer coupled to both the cleaning lance and the examination lance. The indexer may position the lances at openings to bores, so that the feeders may extend the lances into the bores. Entrances to the bores of the heat exchanger may be approximately parallel to each other in a first plane. The indexer may move the cleaning lance and examination lance along the x and y axis of a plane parallel to the first plane to position the cleaning lance and examination lance. For example, the indexer may include one or more motors to move the cleaning lance and examination lance. The indexer may individually control the positioning of each of the cleaning lance and the examination lance. The controller may control the indexer. For example, the controller may control the indexer to position the cleaning lance at the entrance to the first bore of the plurality of bores prior to controlling the first feeder to extend the cleaning lance into the first bore of the plurality of bores. The controller may also control the indexer to position the examination lance at the entrance to the first bore of the plurality of bores prior to controlling the second feeder to extend the examination lance into the first bore. In some embodiments, the controller may receive a layout of the heat exchanger, which may include a layout of the bores of the heat exchanger, distances between the bores, diameters of the bores, and other aspects of the heat exchanger, and may control the indexer to position the cleaning lance and the examination lance based, at least in part, on the received layout.

The controller may control the indexer to separately position the cleaning lance and the examination lance and may control the first feeder and the second feeder to separately extend and retract the cleaning lance and the examination lance. For example, once the cleaning lance has finished cleaning and been retracted from the first bore, the controller may control the indexer to position the cleaning lance at an entrance to a second bore of the plurality of bores before or contemporaneously with controlling the indexer to position the examination lance at the entrance to the first bore of the plurality of bores. The controller may then control the cleaning lance to clean the second bore while controlling the examination lance to examine the first bore. Thus, cleaning and examination of a heat exchanger may take place contemporaneously by examining bores of the heat exchanger with one or more examination lances after they have been cleaned with one or more cleaning lances.

In some embodiments, the first and second feeders may include sensors to sense at least one of travel distance or travel speed of the cleaning lance and examination lance within the bores. The controller may receive, from the one or more sensors, at least one of the travel distance or travel speed of the cleaning lance and/or the examination lance and may control the feeders to extend and retract the lances based on the received travel distance and/or travel speed. For example, in some embodiments, the controller may use the received layout of the heat exchanger along with the received travel speed or distance of a lance to determine a position of a lance within a bore and may control the lance based on the determined position.

An apparatus for cleaning and examination of heat exchangers may include a memory and a processor. The processor may be configured to perform the steps described herein. A method for cleaning and examining heat exchangers may also include steps described herein.

The foregoing has outlined rather broadly certain features and technical advantages of embodiments of the present invention in order that the detailed description that follows may be better understood. Additional features and advantages will be described hereinafter that form the subject of the claims of the invention. It should be appreciated by those having ordinary skill in the art that the conception and specific embodiment disclosed may be readily utilized as a basis for modifying or designing other structures for carrying out the same or similar purposes. It should also be realized by those having ordinary skill in the art that such equivalent constructions do not depart from the spirit and scope of the invention as set forth in the appended claims. Additional features will be better understood from the following description when considered in connection with the accompanying figures. It is to be expressly understood, however, that each of the figures is provided for the purpose of illustration and description only and is not intended to limit the present invention.

BRIEF DESCRIPTION OF THE DRAWINGS

For a more complete understanding of the disclosed system and methods, reference is now made to the following descriptions taken in conjunction with the accompanying drawings.

DETAILED DESCRIPTION

An integrated system for maintenance and examination of heat exchangers may perform both cleaning and examination of heat exchangers. Such integration may enhance efficiency and reduce a cost of cleaning and examination services by allowing cleaning and examination to take place contemporaneously. For example, the system may examine bores of a heat exchanger that have already been cleaned while cleaning bores of the heat exchanger that have not yet been cleaned. Furthermore, such a system may require fewer personnel, thereby reducing the number of personnel placed in potentially hazardous environments. Heat exchangers may, for example, include shell and tube heat exchangers, having a plurality of tubes, or bores, extending through a length of an outer shell, and air coolers, having a plurality of tubes, or bores, bundled in a plenum cooled by direct air flow from one or more motor driven fans.

Figure 1:
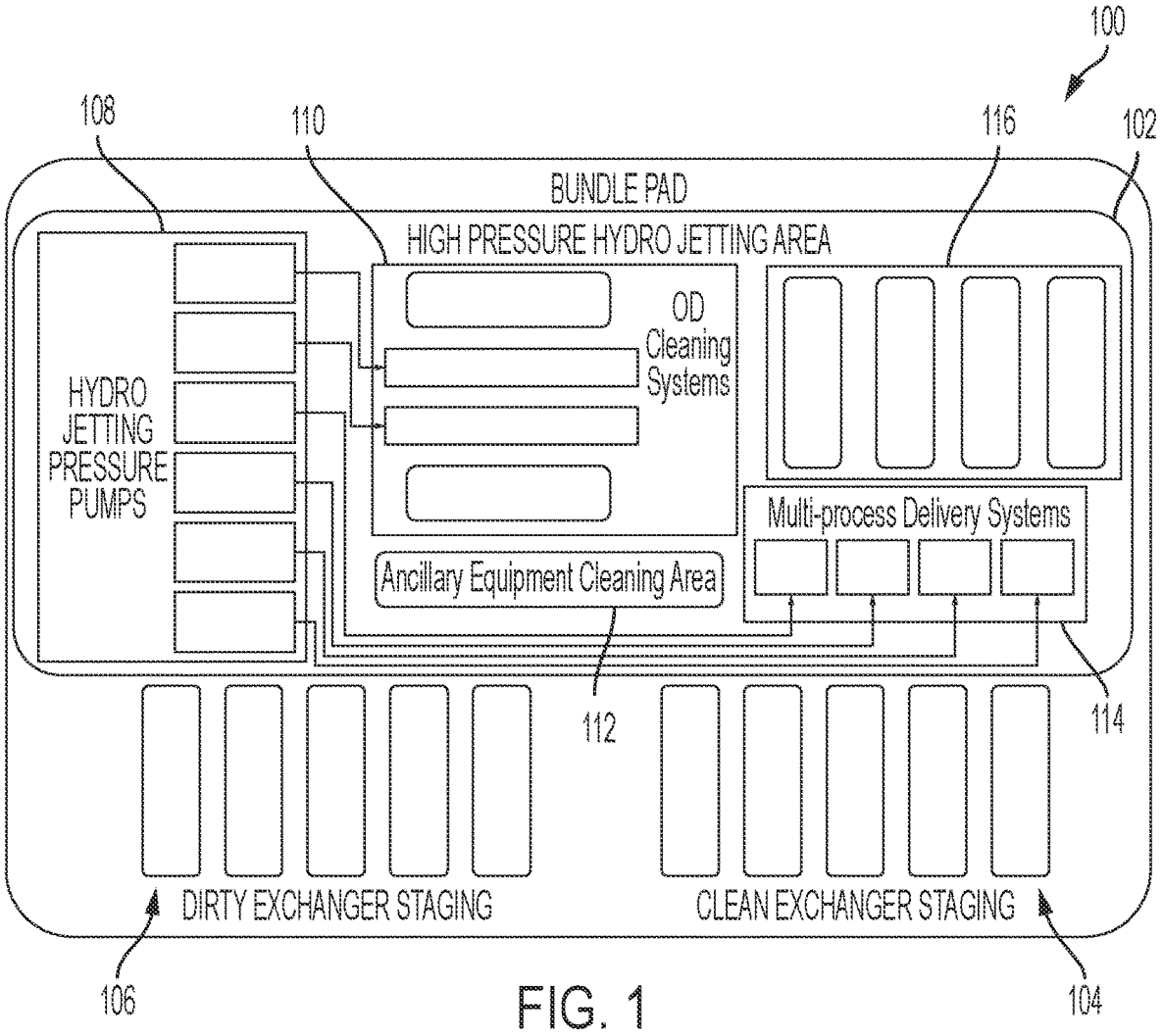
FIG. 1 is an illustration of an example pad layout for maintenance and examination of heat exchangers according to some embodiments of the disclosure.

Some heat exchangers may be cleaned and examined in situ, without dismantling the heat exchanger, while others may require at least some degree of disassembly. Industrial facilities, such as refineries and chemical manufacturing plants, may include upwards of 3000 heat exchangers, and each heat exchanger may include up to and exceeding 500 bores requiring cleaning and examination. After disassembly, heat exchangers may be moved to a bundle pad, such as the bundle pad 100 shown in FIG. 1, for cleaning and examination. Dirty heat exchangers and/or heat exchanger components may be placed in a dirty exchanger staging area 106 and clean heat exchangers and/or heat exchanger components may be placed in a clean exchanger staging 104. When the dirty heat exchangers are ready for cleaning and examination, they may be moved to a high-pressure hydro jetting area 102.

The high-pressure hydro jetting area may include a plurality of hydro jetting pressure pumps 108. The high-pressure hydro jetting area may also include a plurality of air compressors for generating air pressure to dry the tubes after they are washed. The high-pressure hydro jetting area 102 may also include an ancillary equipment cleaning area 112 for cleaning of ancillary heat exchanger equipment, such as pipe runs, spool pieces, filters, valves, and other ancillary heat exchanger equipment. The high-pressure hydro jetting pumps 108 may pump water to one or more outer device (OD) cleaning systems 110 for cleaning the outer surfaces of the heat exchangers. For example, heat exchangers may be moved from the dirty exchanger staging area 106 to the OD cleaning systems area 110 for cleaning of the outer surfaces of the heat exchangers. The hydro-jetting pressure pumps 108 may also pump water to a plurality of multi-process delivery systems 114 for internal cleaning of the heat exchangers in the internal cleaning and examination area 116. After the external surfaces of the heat exchangers are cleaned, they may be moved to the internal cleaning and examination area 116. The multi-process delivery systems 114 may clean the internal bores of the heat exchangers, dry the internal bores of the heat exchangers, and examine the internal bores of the heat exchangers, in a single integrated process. The hydro jetting pressure pumps 108 and the multi-process delivery systems 114 may be part of an integrated system for heat exchanger maintenance and examination.

Figure 2:
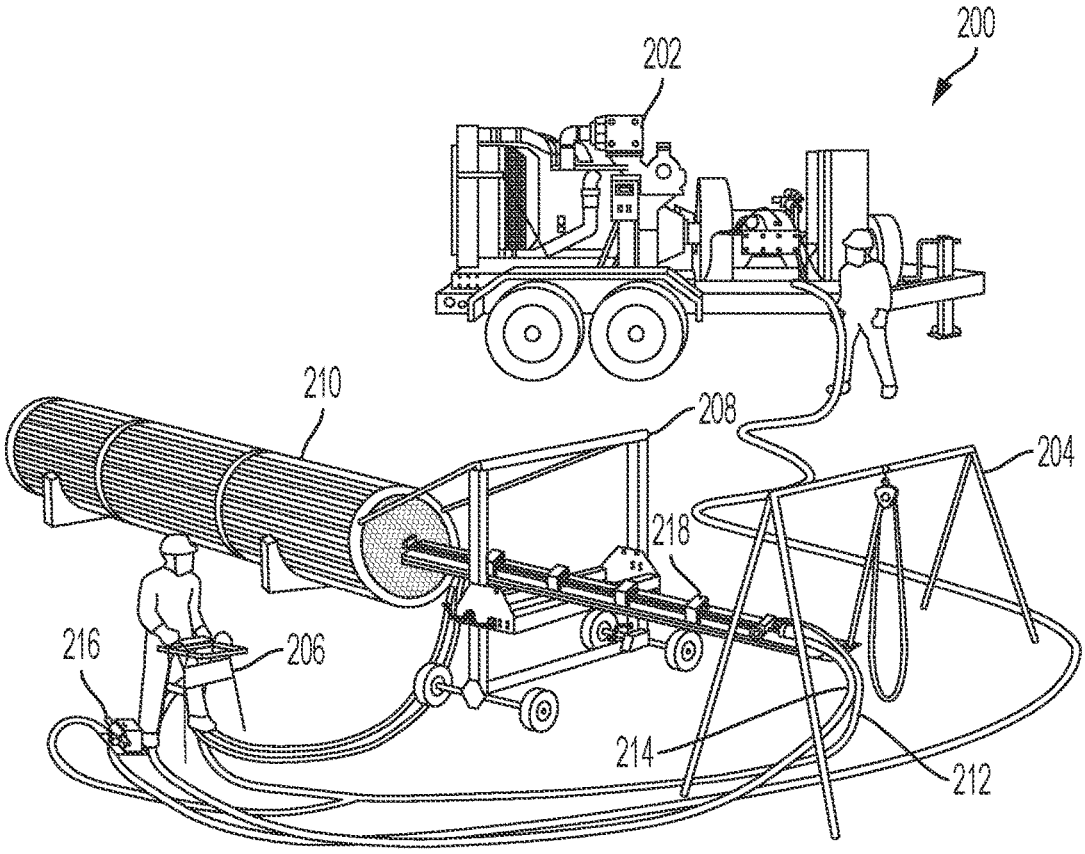
FIG. 2 is a perspective illustration of an example heat exchanger integrated service system according to some embodiments of the disclosure.

An integrated system for heat exchanger maintenance and examination may provide overlapping cleaning and examination of internal bores of heat exchangers. An example integrated system 200 for heat exchanger maintenance and examination is shown in FIG. 2. The system 200 may be particularly effective at cleaning shell and tube and air cooler heat exchangers. The system 200 may include a pump 202, such as a high-pressure water jetting pump, for generating water pressure for cleaning of heat exchanger bores. The pump 200 may be portable and may be a convertible pump capable of producing 10 thousand, 20 thousand, 40 thousand, and more, pounds per square inch (PSI) of pressure. The pump 200 may utilize a quick swap cartridge system to easily swap out pressure ranges in approximately fifteen minutes or less. The high water pressure generated by the pump may provide effective cleaning to the internal surfaces of heat exchanger bores. The pump 202 may have a horsepower up to and exceeding 365. A cleaning lance 212 may connect to the pump 202, and the pump 202 may provide water for cleaning the bores of the heat exchanger. A safety valve 216 may prevent water from flowing through the cleaning lance when the cleaning lance is not inserted into a bore of the heat exchanger 210.

The system 200 may further include a support assembly 204 including one or more feeders 218 for controlling insertion of cleaning lances and examination lances into the bores of the heat exchanger. For example, the feeders 218 may independently control insertion of a cleaning lance 212 and an examination lance 214 into the bores of the heat exchanger, such that the examination lance 214 may be inserted into a first bore of the heat exchanger 210 that has already been cleaned to examine the first bore while the cleaning lance is inserted into and/or cleaning a second bore of the heat exchanger 210. In some embodiments, the feeders 218 may allow independent control of up to and exceeding eight separate lances. A plurality of lances, such as cleaning and examination lances, may be extended and retracted by the feeders 218. For example, a high-pressure water jetting lance may allow for cleaning utilizing water blasting ranging from one thousand to forty thousand PSI. An air lance may dry the bores by pushing out any water and debris remaining in the bores after water jetting. A video borescope lance may allow for remote visual inspection to verify cleaning adequacy, enabling personnel to adjust cleaning techniques as needed during the cleaning and examination process, and for analysis to validate potential defects detected when using a non-destructive testing lance. A non-destructive testing lance may perform eddy current testing, remote field testing, and near field testing. Such testing may include volumetric testing of the bores to determine if wall loss or degradation has occurred. For example, cracking, under-support wall loss, and dealloying may be detected.

An indexer 208 may control positioning of the cleaning and examination lances at the entrances to the bores of the heat exchanger. The indexer 208 may move lances 212, 214 from bores on which they have already performed cleaning and/or examination, to bores that have not yet been cleaned or examined. For example, the indexer may control the positioning of the cleaning and examination lances along an x axis and a y axis, while the feeders 218 may control positioning of the cleaning and examination lances along a z axis.

A controller 206 may control the cleaning and examination lances 212, 214, the indexer 208, and one or more lance feeders 218. For example, the controller 206 may control the indexer to position the cleaning and examination lances at entrances to bores of the heat exchanger 210. The controller 206 may also control the one or more lance feeders 218 to individually extend lances into and retract lances from the bores of the heat exchanger 210. The controller 206 may also control the cleaning lances to clean the bores and the examination lances to examine the bores. In some embodiments, the controller 206 may also control the safety valve 216 to enable or prevent flow of a fluid, such as water, from the pump 202 to a cleaning lance 212 and the pump 202 to begin or stop pumping water to the cleaning lance. For example, safety valves, such as safety valve 216, may be used to direct flow of water and air outside the system, such as to the external environment, until the lances are in position for cleaning and/or drying. Thus, the system 200 may allow for cleaning and examination of bores of a heat exchanger 210 in a single unified process.

Figure 3:
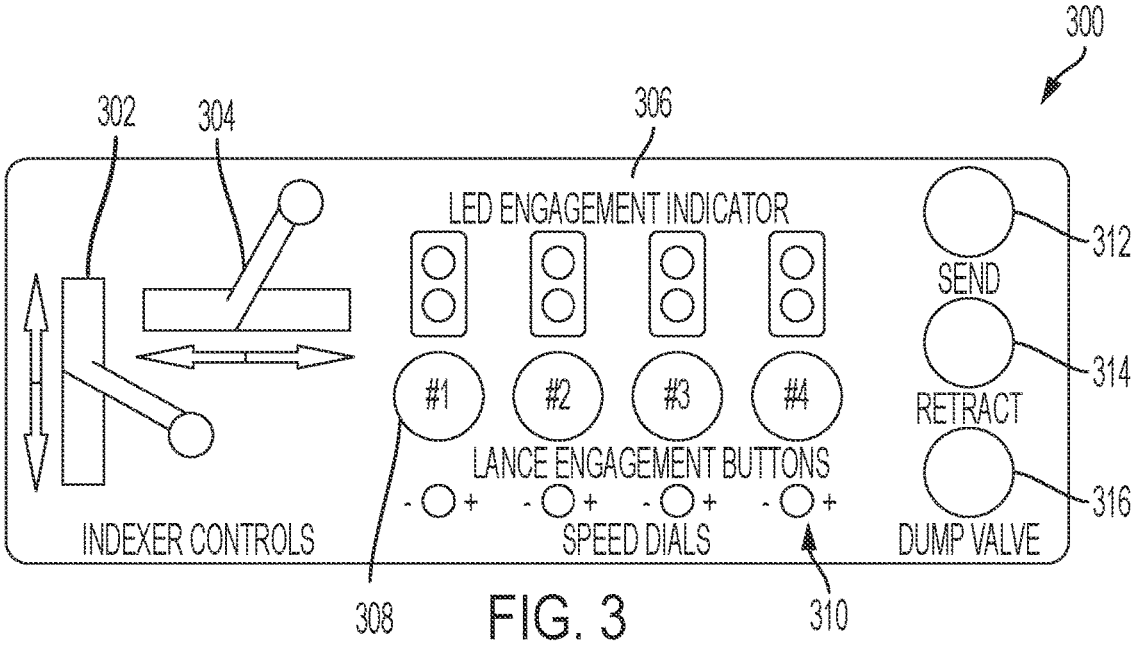
FIG. 3 is an illustration of an example control panel for an heat exchanger integrated service system according to some embodiments of the disclosure.

An example control panel 300 for a controller for an heat exchanger integrated service system is shown in FIG. 3. The control panel 300 may, for example, allow for manual control of aspects of such a system. For example, a first indexer control lever 302 may control a y axis position of the indexer, and, by extension, one or more cleaning and examination lances, at the entrances to one or more bores of a heat exchanger. For example, when the lances are retracted from the bores of the heat exchanger, the lever 302 may be used to move the lances up, to higher bores, or down, to lower bores. The control lever 304 may control an x axis position of the indexer, and, by extension, one or more cleaning and examination lances. For example, when the lances are retracted, the lever 304 may control the indexer to move the one or more lances to the left or to the right. One or more lance engagement buttons 308 may enable individual control of one or more lances. An operator may press one of the lance engagement buttons 308 to engage individual control of one or multiple cleaning and/or examination lances. For example, a first lance engagement button may engage control of a cutting lance. A second lance engagement button may engage control of a polishing lance. In some embodiments, a cutting and polishing lance may be consolidated into a single universal lance, such as when bores of an exchanger require minimal cleaning. A third lance engagement button may engage control of an air-dry lance. A fourth lance engagement button may engage control of an examination probe lance. An LED engagement indicator 306 may show which lances are engaged and/or currently being controlled. A plurality of speed dials 310 may allow for individual control of a speed of extending and/or retracting multiple lances. A send button 312 may cause one or more lance feeders to extend one or more lances currently engaged into one or more bores of a heat exchanger. A retract button 314 may cause one or more lance feeders to retract one or more lances currently engaged from one or more bores of a heat exchanger. A dump valve button 316 may activate a valve to remove water pressure from one or more cleaning lances expelling water from a pump into the environment. In some embodiments, the control panel 300 may include a video screen displaying a video feed from a live action camera attached to or near the indexer or from a video borescope of an examination lance.

Figure 4:
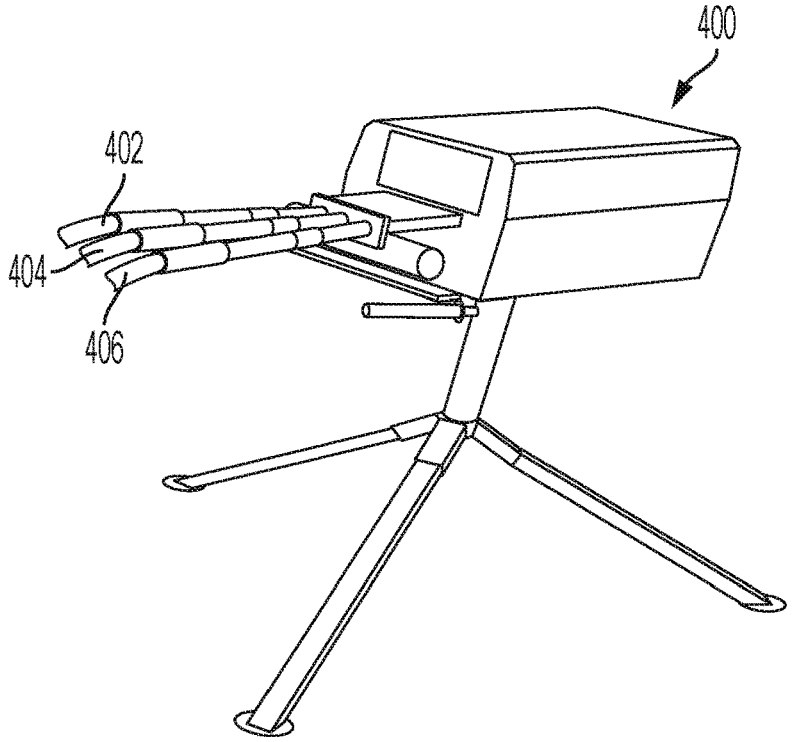
FIG. 4 is a perspective illustration of a feeder according to some embodiments of the disclosure.

An example lance feeder 400 on a stand is shown in FIG. 4. The lance feeder may enable individual control of extension and retraction of individual lances into one or more bores of a heat exchanger. For example, the lance feeder may control a water cleaning lance 402, a drying lance 404, and a video borescope lance 406. The feeder may, for example, extend the water cleaning lance 402 into a bore for cleaning and may retract the water cleaning lance 402 after the bore is cleaned. In some embodiments, the lance feeder 400 may extend multiple lances into multiple bores simultaneously, with the multiple lances performing different processes simultaneously to improve throughput of the lancing process. The lance feeder 400 may include three to four, or more, independently driven feeders. The feeders of the lance feeder 400 may each be independently driven by pneumatic, hydraulic, electric, or fueled motors to extend and retract the lances. The lance feeder 400 may be positioned near a tube sheet of an exchanger that is being cleaned and examined.

Figure 5:
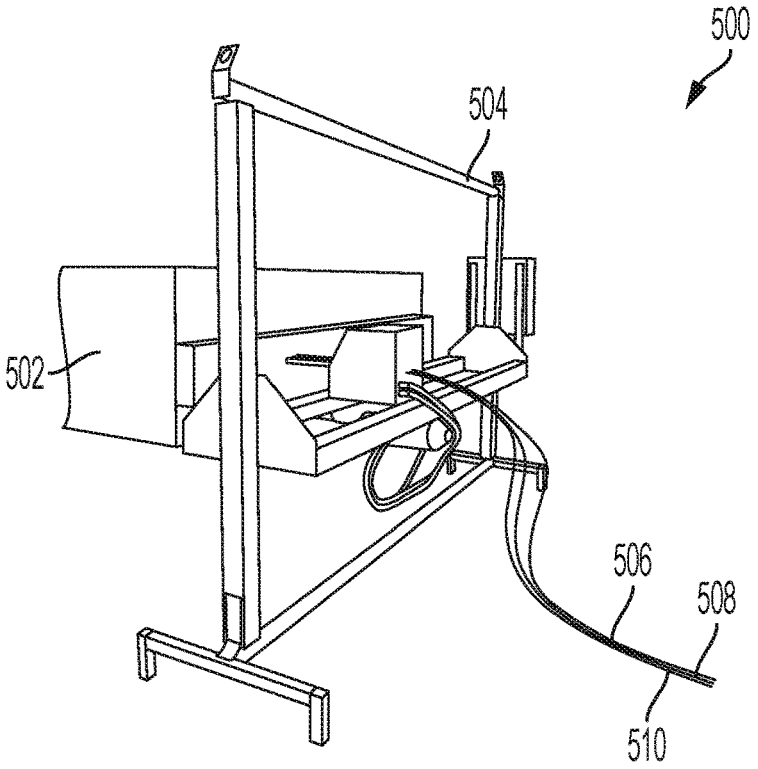
FIG. 5 is a perspective illustration of an indexer according to some embodiments of the disclosure.

An example stationary indexer 504 implementation 500 is shown in FIG. 5. The indexer 504 may adjust a position of one or more lances across an x-y plane at the entrance to a plurality of bores of a heat exchanger 502. In some embodiments, the indexer 504 may individually control the positioning of each lance, while in other embodiments, the indexer 504 may maintain positioning of the lances in relationship to each other while adjusting a position of the lances across the face of the heat exchanger 502. For example, a first cleaning lance 506 may facilitate flow of high-pressure water for cleaning one or more bores. The first cleaning lance 506 may, for example, include a cleaning nozzle at the end of the first lance 506 that is inserted into the bores of the heat exchanger. A second cleaning lance 508 may include a pressurized air input for drying one or more bores. A third, examination, lance 510 may include a communications cable for a video borescope at an end of the third lance inserted into the bores of a heat exchanger. As one example, the indexer 504 may first position the first lance at an entrance to a first bore of the heat exchanger 502. The first lance 506 may apply pressurized water from the first tube 506 to the bore to clean the first bore. The indexer 504 may then move the first lance 506 to a second bore to clean the second bore while moving the second lance 508 to the first bore to dry the first bore with pressurized air from the second cleaning lance 508. The indexer 504 may then position the first lance 506 outside of a third bore, to clean the third bore, the second lance 504 outside of the second bore, to dry the second bore, and the third lance 510 outside of the first bore, to examine the first bore. The indexer 504 may be driven by one or more pneumatic motors to move the lances vertically and horizontally across the face of the heat exchanger. The indexer 504 may include a metal frame with an internal bar holding the guide tubes. Thus, the indexer 504 may move the lances as a group to progressively apply steps, such as cleaning, drying, and examination, to each bore of the heat exchanger 502. In some embodiments, additional lances may be positioned by the indexer 504, such as non-destructive testing lances.

Figure 6:
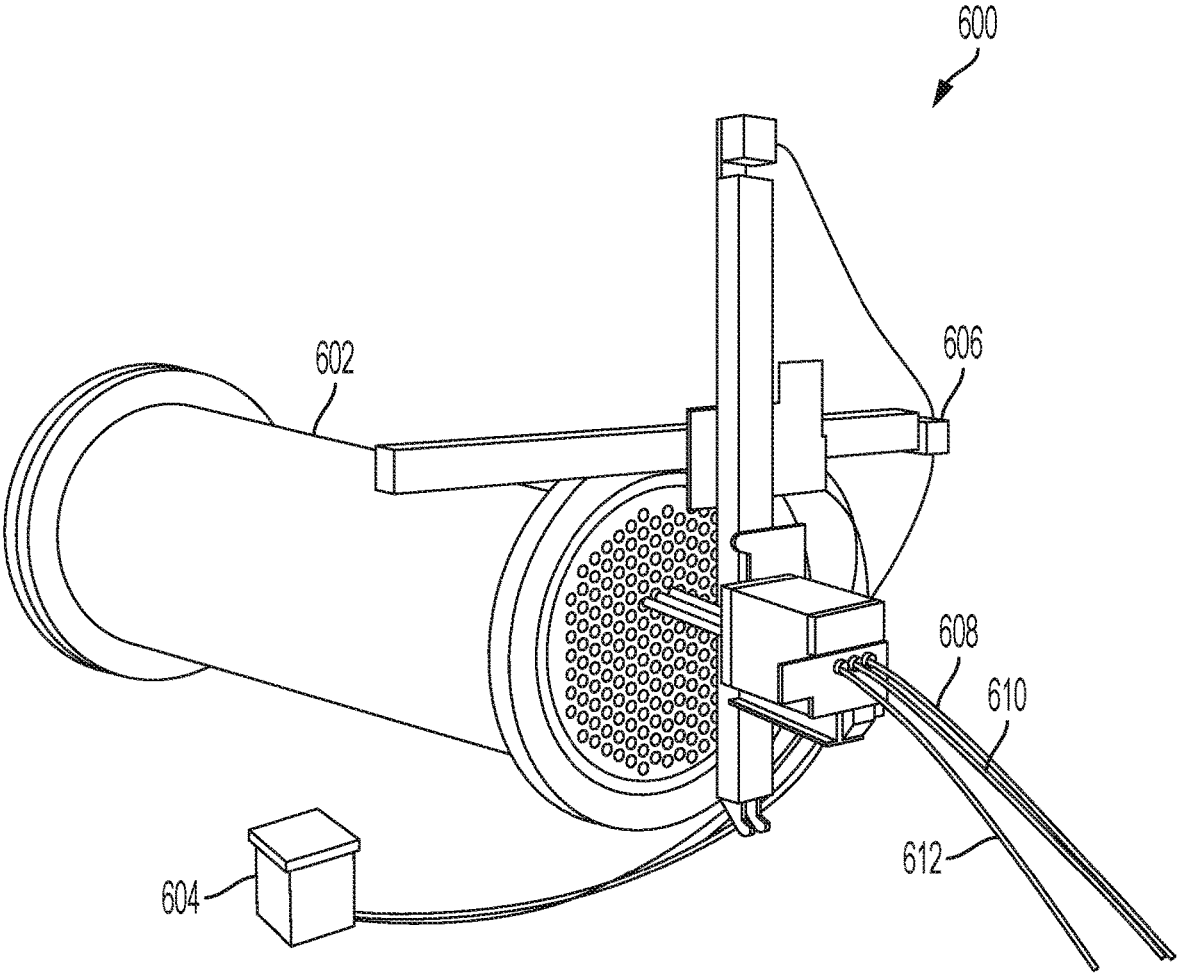
FIG. 6 is a perspective illustration of a portable indexer according to some embodiments of the disclosure.

An example implementation 600 of a portable indexer 606 is shown in FIG. 6. The portable indexer 606 may operate similarly to the stationary indexer 504, but may provide greater flexibility in cleaning and examination of heat exchangers. For example, the portable indexer 606 may be positioned at a face of a heat exchanger 602 in situ for cleaning and examination of bores without requiring disassembly of the heat exchanger 602. A control box 604 controlled by a controller may control the indexer's positioning of one or more cleaning lances across an xy plane parallel to the face of the heat exchanger 602. For example, the indexer 606 may position a first lance 608, which may be a cleaning lance connected to a pump to supply water, or another fluid, to the first lance 608. The indexer 606 may also position a second lance, which may be a drying lance 610 connected to an air compressor to supply air to the drying lance. The indexer 606 may position a third lance 612, which may be a video borescope lance, connected to a control panel by a data line to transfer video data from a camera of the third lance to a controller. In some embodiments, the indexer 606 may position additional lances. For example, the indexer may position multiple cleaning lances such as water cutting and water polishing lances.

A set of lances may perform a series of steps on each bore of a heat exchanger to clean and inspect the bores of the heat exchanger. For example, each lance may be designed to perform a specific cleaning or examination function, water cutting, water polishing, air-drying, video inspection, and non-destructive testing. An example four stage process with a four by one movement mode for cleaning and examination of a heat exchanger is shown in FIGS. 7A-7E. The first stage 700, shown in FIG. 7A, includes a first function being performed on a first borehole 702 of the heat exchanger. For example, a cleaning lance, such as a water jetting cutting lance, may perform a first cleaning process on the first bore 702. A controller may control an indexer to move the first lance for performing the first function to an entrance of the first borehole 702 and may control a first lance feeder to extend the lance into the first borehole 702. The controller may control the first lance to perform the first cleaning function and may then control the first lance feeder to retract the first lance from the first borehole 702.

Figure 7A:
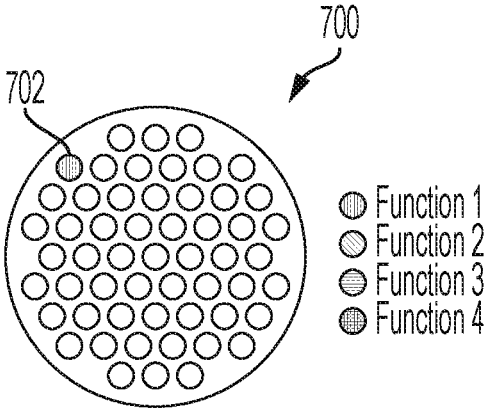
FIG. 7A is an illustration of a first stage of a four by one heat exchanger cleaning and examination process according to some embodiments of the disclosure.
Figure 7B:
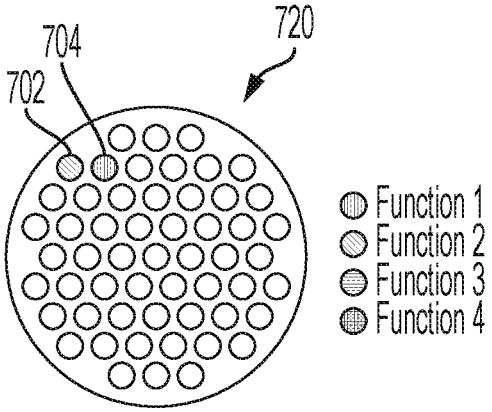
FIG. 7B is an illustration of a second stage of a four by one heat exchanger cleaning and examination process according to some embodiments of the disclosure.

The second stage 720, shown in FIG. 7B, includes a second function being performed on the first borehole 702 and a first function being performed on a second borehole 704. The second function may, for example, be a cleaning function, such as a water polishing function, performed by a second cleaning lance. For example, a controller may control an indexer to move the first lance to the entrance of the second borehole 704 and the second lance to the entrance of the first borehole 702. In some embodiments, the lances may be positioned at a fixed distance from each other, such that as the first lance is moved, the second lance, and other lances, are moved the same distance in the same direction. The controller may control the first lance feeder to extend the first lance into the second borehole 704 and a second lance feeder to extend the second lance into the first borehole 702. In some embodiments, the controller may control the feeders to individually insert the lances into the boreholes at different times, or at the same time. The controller may control the first lance to perform the first cleaning function and the second lance to perform the second cleaning function. The controller may then control the first lance feeder and the second lance feeder to retract the first lance from the second borehole 704 and the second lance from the first borehole 702.

Figure 7C:
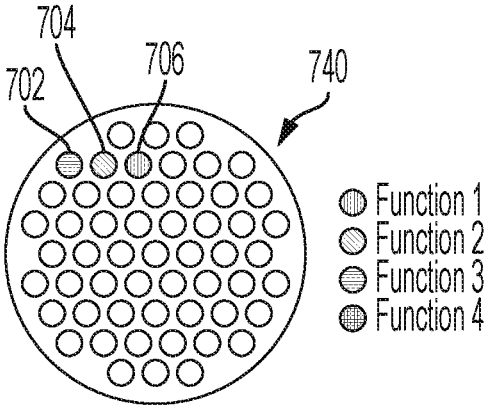
FIG. 7C is an illustration of a third stage of a four by one heat exchanger cleaning and examination process according to some embodiments of the disclosure.

The third stage 740, shown in FIG. 7C, includes a third function being performed on the first borehole 702, the second function being performed on the second borehole 704, and the first function being performed on a third borehole 706. The third function may, for example, be a drying function, such as air-drying, performed by a third cleaning lance. For example, a controller may control an indexer to move the first lance to the entrance of the third borehole 706, the second lance to the entrance of the second borehole 704, and the third lance to the entrance of the first borehole 702. The controller may control the first lance feeder to extend the first lance into the third borehole 706, a second lance feeder to extend the second lance into the second borehole 704, and a third lance feeder to extend the third lance into the first borehole 702. The controller may control the first lance to perform the first cleaning function, the second lance to perform the second cleaning function, and the third lance to perform the drying function. The controller may then control the first lance feeder, the second lance feeder, and the third lance feeder to retract the first lance from the third borehole 706, the second lance from the second borehole 704, and the first lance from the first borehole 702.

Figure 7D:
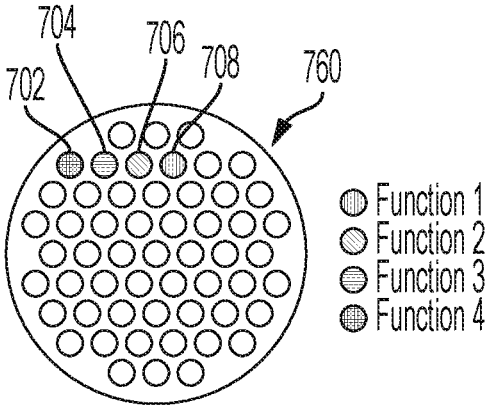
FIG. 7D is an illustration of a fourth stage of a four by one heat exchanger cleaning and examination process according to some embodiments of the disclosure.

The fourth stage 760, shown in FIG. 7D, includes a fourth function being performed on the first borehole 702, the third function being performed on the second borehole 704, the second function being performed on the third borehole 706, and the first function being performed on a fourth borehole 708. The fourth function may, for example, be an examination function, such as a video borescope analysis, performed by a fourth lance. For example, a controller may control an indexer to move the first lance to the entrance of the fourth borehole 708, the second lance to the entrance of the third borehole 706, the third lance to the entrance of the second borehole 704, and the fourth lance to the entrance of the first borehole 702. The controller may control the first lance feeder to extend the first lance into the fourth borehole 708, a second lance feeder to extend the second lance into the third borehole 706, the third lance feeder to extend the third lance into the second borehole 704, and the fourth lance feeder to extend the fourth lance into the first borehole 702. The controller may control the first lance to perform the first cleaning function, the second lance to perform the second cleaning function, the third lance to perform the drying function, and the fourth lance to perform the examination function. The controller may then control the first lance feeder, the second lance feeder, the third lance feeder, and the fourth lance feeder to retract the first lance from the fourth borehole 708, the second lance from the third borehole 706, the third lance from the second borehole 704, and the fourth lance from the first borehole 702.

Figure 7E:
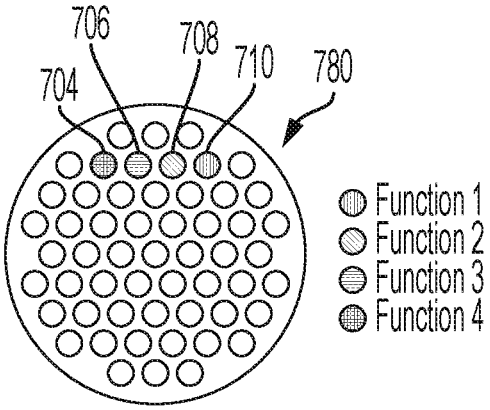
FIG. 7E is an illustration of a fifth stage of a four by one heat exchanger cleaning and examination process according to some embodiments of the disclosure.

Thus, the lances may progressively perform a series of steps on each borehole of a heat exchanger by performing first, second, third, and fourth steps with first, second, third, and fourth lances on each borehole. For example, a fifth stage 780, shown in FIG. 7E, shows the lances proceeding across the array of boreholes. For example, a controller may control an indexer to move the first lance to the entrance of the fifth borehole 710, the second lance to the entrance of the fourth borehole 708, the third lance to the entrance of the third borehole 706, and the fourth lance to the entrance of the second borehole 704. The controller may control the first lance feeder to extend the first lance into the fifth borehole 710, a second lance feeder to extend the second lance into the fourth borehole 708, the third lance feeder to extend the third lance into the third borehole 706, and the fourth lance feeder to extend the fourth lance into the second borehole 704. The controller may control the first lance to perform the first cleaning function, the second lance to perform the second cleaning function, the third lance to perform the drying function, and the fourth lance to perform the examination function. The controller may then control the first lance feeder, the second lance feeder, the third lance feeder, and the fourth lance feeder to retract the first lance from the fifth borehole 710, the second lance from the fourth borehole 708, the third lance from the third borehole 706, and the fourth lance from the second borehole 704. In some embodiments, fewer than four lances may be used to perform a progression of steps across the boreholes of a heat exchanger. For example, a cutting function and a polishing function may be combined into a single water cleaning function performed by a single lance. In some embodiments, more than four lances may be used to perform a progression of steps across the boreholes of a heat exchanger. For example, an additional function, such as a non-destructive testing function may be performed by a fifth lance. Alternatively, the functions performed by lances may be rearranged and/or substituted for other functions. In some embodiments, a single lance may perform a single function on all boreholes in a one by one movement mode. Other movement modes may include two by one movement modes, with two functions being performed on each borehole, and three by one movement modes, with three functions being performed on each borehole.

Figure 8A:
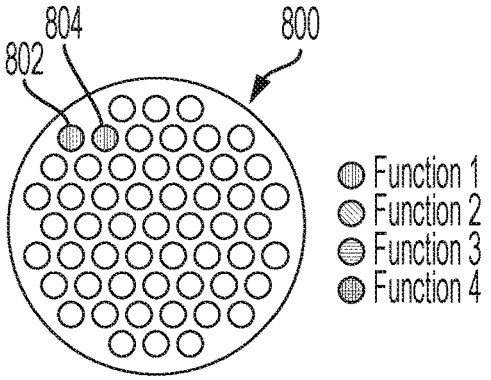
FIG. 8A is an illustration of a first stage of a two by two heat exchanger cleaning and examination process according to some embodiments of the disclosure.
Figure 8B:
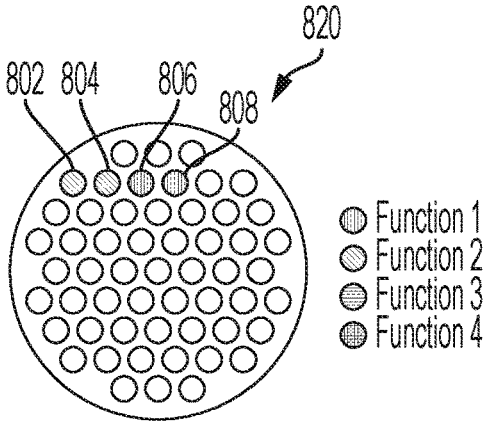
FIG. 8B is an illustration of a second stage of a two by two heat exchanger cleaning and examination process according to some embodiments of the disclosure.
Figure 8C:
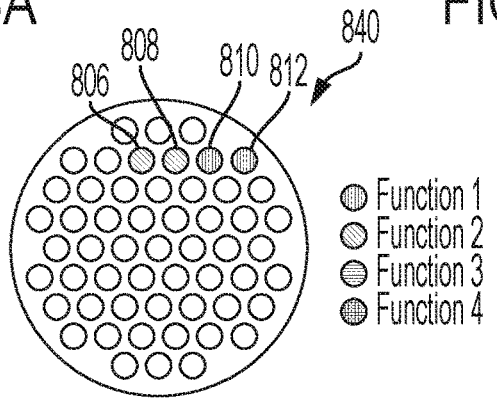
FIG. 8C is an illustration of a third stage of a two by two heat exchanger cleaning and examination process according to some embodiments of the disclosure.

In some embodiments, multiple lances for performing the same functions may be included. For example, as shown in the two-stage process with a two by two movement mode of FIGS. 8A-8C, multiple lances may perform the same function. For example, in a first stage 800, as shown in FIG. 8A, a first function, such as a water cleaning function, may be performed by a first lance on a first borehole 802 and a second lance on a second borehole 804. In a second stage 820, as shown in FIG. 8B, the first and second lances may perform the first function on a third borehole 806 and a fourth borehole 808. Third and fourth lances may perform a second function, such as a video borescope function or a drying function, on the first borehole 802 and the second borehole 804. In a third stage 840, the third and fourth lances may perform the second function on the third borehole 806 and the fourth borehole 808, and the first and second lances may perform the first function on a fifth borehole 810 and a sixth borehole 812. Thus, when two lances are performing each function, each step may be performed on two boreholes at a time, and the set of lances may be moved across the heat exchanger multiple boreholes at a time. Other movement modes may include a four by two movement mode, with four functions being performed and a two borehole movement pattern, a three by two movement mode, with three functions being performed and a two borehole movement pattern, and a one by two movement mode, with a single function being performed on every other borehole.

Figure 9A:
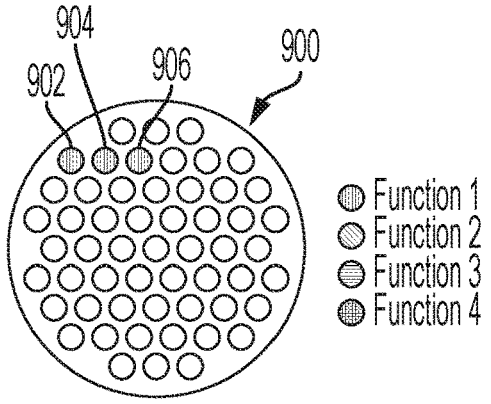
FIG. 9A is an illustration of a first stage of a two by three heat exchanger cleaning and examination process according to some embodiments of the disclosure.
Figure 9B:
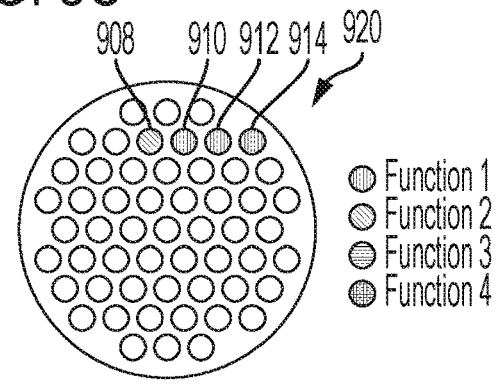
FIG. 9B is an illustration of a second stage of a two by three heat exchanger cleaning and examination process according to some embodiments of the disclosure.
Figure 9C:
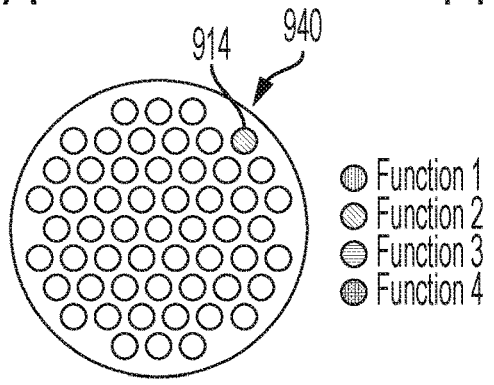
FIG. 9C is an illustration of a third stage of a two by three heat exchanger cleaning and examination process according to some embodiments of the disclosure.

A third example process, shown in FIGS. 9A-9C shows a two-stage process with a two by three movement mode. For example, in the first step 900 shown in FIG. 9A, first, second, and third lances may perform a first function, such as cleaning, on first second and third boreholes 902, 904, 906. In a second step 920, shown in FIG. 9B, the first, second, and third lances may perform the first function on fourth fifth and sixth boreholes 910, 912, 914. A fourth lance may perform a second function, such as video examination or non-destructive testing on the third borehole 908. In a third step 940, shown in FIG. 9C, the fourth lance may perform the second function on the sixth borehole 914. Thus, certain functions may be performed on all boreholes, while other functions may be performed on a subset of the boreholes. For example, all boreholes may be cleaned while a subset of boreholes are examined. Other movement modes may include a three by three movement mode, with three functions being performed and a three-borehole movement pattern, and a one by three movement mode, with a single function being performed on every third borehole.

Figure 10:
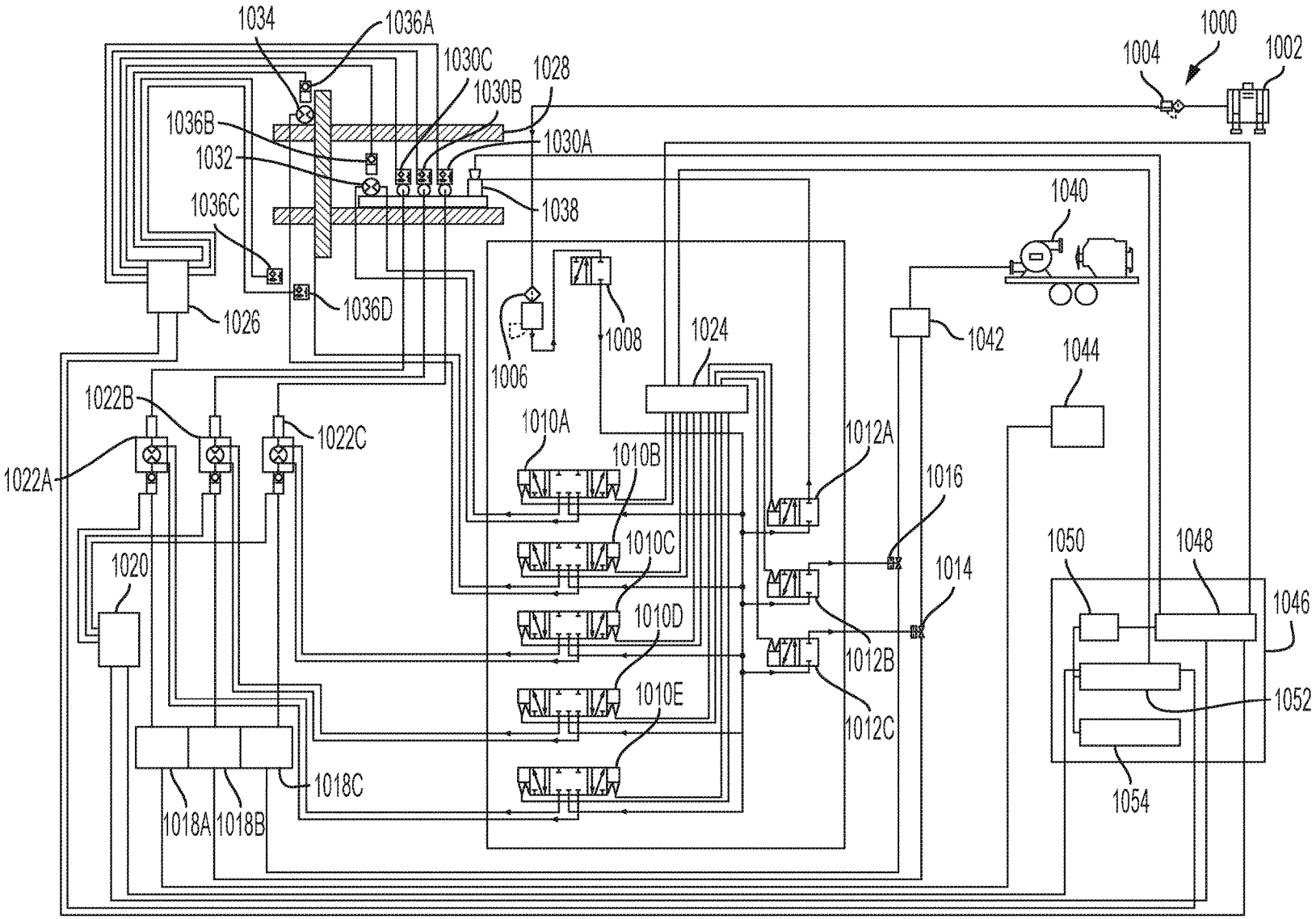
FIG. 10 is a schematic layout of an heat exchanger integrated service system according to some embodiments of the disclosure.

A system for cleaning and maintenance of heat exchangers and air coolers may include multiple cleaning and/or examination lances. An example system 1000 for cleaning and examination of heat exchangers and air coolers is shown in FIG. 10. A controller 1046 may control components of the system 1000. The controller 1046 may include a switch 1048 for communicating with one or more components of the system 1000. For example, the switch 1048 may communicate with a camera 1038, such as an action vision camera, connected to the indexer 1028. For example, the switch 1048 may route video information from the camera 1038 to a remote server or to a terminal of an operator for analysis of video collected by the camera. Alternatively, the controller 1046 may include a video display for displaying video received from the camera 1038. The controller 1046 may also communicate with a first remote input output terminal 1024, a second remote input output terminal 1020, and a third input output terminal 1026 to control operation of components of the system 1000. For example, the controller 1046 may communicate with the input output terminals to control movement of lances with an indexer 1028 and insertion and retraction of lances by lance feeders 1022A-C by communicating with the indexer 1028 and the lance feeders 1022A-C via the switch 1048 and the remote input output terminals 1020, 1024, 1026. The controller 1046 may include a processing unit 1050. The controller 1046 may also include a power distributor 1052 to supply power to the components of the system 1000. The controller 1046 may also include a programmable logic controller 1054. The controller 1046 may include a master control switch, only allowing the system 1000 to function when the switch is engaged. The controller 1046 may allow for selection of a preferred lance travel speed and specific lance functions, such as pecking and burning.

The system 1000 may include a high-pressure water jet pump 1040. A pressure diverter valve 1042 may control flow of water from the pump 1040 and provide water flow to multiple cleaning lances of the system 1000. A first pneumatic air valve 1016 may control flow of water through a first line to a first cleaning lance 1030A. The first pneumatic air valve 1016 may be controlled by controller 1046. A second pneumatic air valve 1014 may control flow of water through a second line to a second cleaning lance 1030B and may be controlled by controller 1046. The first and second pneumatic air valves 1016, 1014 may be two position two way three port air diverter valves. The first and second water lines may feed into a first lance reel 1018B and a second lance reel 1018C. The first and second lance reels 1018B-C may feed into a first lance feeder 1022B and a second lance feeder 1022C. The first and second lance feeders 1022B-C may each be controlled by controller 1046. The first and second lance feeders 1022B-C may each include gas pneumatic motors and incremental rotary encoders which may also be controlled by the controller 1046. The first and second lance feeders 1022B may extend first and second cleaning lances 1030A-B into and retract first and second cleaning lances 1030A-B from bores of a heat exchanger. The first and second cleaning lances 1030A-B may include inductive proximity sensors for sensing the surface of bores being cleaned. The proximity sensors may, for example, communicate with the controller 1046 via the third input output terminal 1026.

Examination equipment 1044 may be connected to a third lance reel 1018A for examining one or more bores of the heat exchanger. The third lance reel may be connected to a third lance feeder 1022A for extending a third, examination, lance 1030C into and retracting the third lance 1030C from one or more bores of a heat exchanger. The lance reels 1018A-C may keep the lances inside of a containment to keep lances organized, enhancing site safety. The lance reels 1018A-C may also include lance stops for preventing over extension and retraction of the lances. The third, examination, lance 1030C may include an inductive proximity sensor which may also communicate with the controller 1046. The examination equipment 1044 may receive testing data, such as video data or non-destructive testing data, from the third lance. In some embodiments, the lances 1030A-C may be encased inside whips, or outer hose layers, that direct the lances and may serve as an extra layer of containment in case of lance failure.

A pneumatic air system may be used to control movement of the lance feeders 1022A-C and the indexer 1028 and flow of water through the cleaning lances 1030A-B. For example, an air compressor 1002 may generate air pressure for pressurizing the pneumatic control system and for energizing an air-drying cleaning lance. Regulator/filters 1004, 1006 may control pressure applied to the system from the air compressor 1002. A pneumatic valve 1008, such as a two position two-way three port air pilot valve, may further control air pressure applied to the system. A first movement control valve 1010A may control pressure applied to a first pneumatic motor 1032 for moving the indexer 1028. A second movement control valve 1010B may control pressure applied to a second pneumatic motor 1034 for moving the indexer 1028. A third movement control valve 1010C may control pressure applied to a pneumatic motor of the second lance feeder 1022C to cause the second lance feeder 1022C to extend or retract the first cleaning lance 1030A. A fourth movement control valve 1010D may control pressure applied to a pneumatic motor of the first lance feeder 1022B to cause the second lance feeder 1022B to extend or retract the second cleaning lance 1030B. A fifth movement control valve 1010E may control pressure applied to a pneumatic motor of the third lance feeder 1022A to cause the third lance feeder 1022A to extend or retract the third, examination, lance 1030C. In some embodiments, the lance feeders 1022A-C may be driven by electric or hydraulic motors. The first, second, third, fourth, and fifth movement control valves 1010A-E may be three position four-way five port electric solenoid valves and may be controlled by the controller 1046 via the first remote input output terminal 1024.

A sixth movement control valve 1012A may control pressure applied to a pneumatic motor of the camera 1038 to control positioning of the camera 1038. A seventh movement control valve 1012B may control pressure applied to the first pneumatic air valve 1016 to control a flow of water through the first line. An eighth movement control valve 1012C may control pressure applied to the second pneumatic air valve 1014 to control a flow of water through the second line. The sixth, seventh, and eighth movement control valves 1012A-C may be controlled by the controller 1046 via the first remote input output terminal 1024.

The indexer 1028 may include a first rotary indexer 1036A and a second rotary indexer 1036B. The first and second rotary indexers 1036A-B may communicate with the controller 1046 via the third remote input output terminal 1026. For example, the rotary indexers 1036A-B may transmit precise coordinate information regarding positioning of the indexer 1028 and the lances 1030A-C to the controller 1046, and the controller 1046 may correlate the indexer and lance coordinates to match heat exchanger tube coordinates to verify alignment of the lances with the heat exchanger tubes. Additional inductive proximity sensors 1036C-D may be positioned on or about the indexer 1028 as well and may communicate with the controller 1046 via the third remote input output terminal 1026. The controller 1046 may use information from the proximity sensors 1036C-D to verify positioning of the lances prior to high-pressure activation and/or motor movement. Thus, a heat exchanger integrated service system 1000 may enable a controller 1046 to control multiple processes being performed on bores of a heat exchanger by multiple lances. The indexer 1028 may include a guide tube assembly to guide and support the first, second, and third lances 1030A-C.

The system 1000 may be set up in approximately 90 minutes or less. Lance options may be selected, such as a series of functions to be performed on one or more bores, and a layout of a heat exchanger may be received. The system 1000 may then be calibrated to provide the controller 1046 with information as to the location relationship between the lances 1030A-C and the bores of the heat exchanger being serviced. The controller 1046 may assign a specific pair of coordinates to each bore of the heat exchanger being tested based on the received layout. Such automation may enhance safety, efficiency, and accuracy. The system 1000 may be operated with a variety of different modes. For example, the system 1000 may be operated in a full manual mode with an operator at a control panel of the controller 1046 manually controlling operation of all aspects of the system, such as positioning of the indexer, operation of the lance feeders, and operation of the lances. In another operation mode, the system 1000 may be operated with automatic indexing but manual control of the lances. For example, the controller 1046 may automatically control the indexer 1028 to position the lances 1030A-C at the entrances to bores, and an operator may manually control the lance feeders 1022A-C and the lances 1030A-C. In another operation mode, the system 1000 may be operated with automatic control of the lance feeders 1022A-C and the lances 1030A-C but manual control of the indexer 1028. In another operation mode, the controller 1046 may automatically control positioning of lances 1030A-C, via the indexer 1028, extension and retraction of lances 1030A-C, via the lance feeders 1022A-C, and operation of the lances 1030A-C.

The system 1000 may be configured to implement a variety of safety protocols. For example, a master switch, such as a foot pedal of the controller 1046 may enable an operator to automatically halt operation of the system 1000. For example, a foot pedal may actuate a peer to peer signal, a peer to ethernet signal, or an ethernet to ethernet signal to a master control switch or valve to shut down the system. The indexer 1028 may implement an end stop slide mechanism to limit movement of the indexer. Furthermore, the indexer 1028 and/or lance feeders 1022A-C may include home sensors for sensing that lances have been retracted from the bores prior to adjusting positioning of the lances. Encoder sensors of the indexer 1028 may also require zeroing from lance retraction prior to allowing adjustment of positioning of the lances 1030A-C. The indexer 1028 may include physical stops to bound movement of the indexer, position sensors for locating zeroed coordinates of the indexer, and encoding sensors for measuring distance traveled by the indexer 1028 across an xy plane. The lance feeders 1022A-C may implement a physical lance stop in the reverse direction to prevent over-retraction of lances 1030A-C and a physical lance stop in the forward direction to prevent over-extension of the lances 1030A-C. The lance feeders 1022A-C may also include encoders to measure lance travel. The system 1000 may also include a smart vision system to verify alignment of lances 1030A-C and bores. For example, the controller 1046 may operate vision alignment software to verify alignment, with input from one or more pneumatic or electric cylinder sensors that are activated when fully extended. In one embodiment, the smart vision system may be coupled to the controller and configured to provide feedback to the controller to assist in aligning the cleaning lance and the first bore, as well as other lances and bores.

A heat exchanger integrated service system may perform a series of maintenance and/or examination functions on each of a plurality of bores of a heat exchanger. An example method 1100 for cleaning and examination of a heat exchanger may begin, at step 1102, with positioning a cleaning lance at an entrance to a first bore of the heat exchanger. For example, an indexer may be controlled to move a first bore to be positioned at an entrance to a first bore of the heat exchanger. The cleaning lance may be a water jetting lance. Lance options may include high-pressure water jetting, air lancing, video borescope, and non-destructive testing.

At step 1104, the cleaning lance may be extended into the first bore. For example, a first lance feeder may be controlled to extend the first lance into the first bore. In some embodiments, the first lance feeder and/or first lance may include one or more sensors for sensing a distance traveled by the first lance into the first bore and/or a speed of the first lance. In some embodiments the distance traveled and/or speed may be transmitted by the sensors to a controller and the controller may control operation of the first lance feeder based, at least in part on the received distance traveled and/or speed.

When the first lance is extended into the first bore, the first lance may, at step 1106, clean the first bore. For example, a controller may control the first lance to clean the first bore. The first lance may jet water into the first bore. In some embodiments the first lance may perform a cutting cleaning function. In other embodiments, the first lance may perform a polishing function. In some embodiments, the first lance may perform both a cutting and a polishing cleaning function.

At step 1108, the first cleaning lance may be retracted from the first bore. For example, a controller may control the first lance feeder to retract the first lance from the first bore when the cleaning operation is completed.

At step 1110, the first cleaning lance may be positioned at an entrance to a second bore. For example, an indexer may move the first cleaning lance from the entrance to the first bore to the entrance to the second bore. For example, bores of a heat exchanger may be positioned approximately equidistant from one another. The controller may be configured to automatically move the first lance from bore to bore until the first lance has cleaned all bores of the first heat exchanger.

At step 1112, a second, examination, lance may be positioned at the entrance to the first bore. In some embodiments, multiple cleaning lances, such as cutting, polishing, and air-drying lances may be successively positioned in front of the first bore to perform multiple cleaning steps on the first bore before the examination lance is positioned at the entrance to the first bore. The examination lance may, for example, be a video borescope lance or a non-destructive testing lance. A controller may control the indexer to position the examination lance at the entrance to the first bore. In some embodiments the controller may control the indexer to position each lance individually. In other embodiments, the lances may be positioned on the indexer approximately the same distance apart as the centers of adjacent bores of the heat exchanger. Thus, the lances may be moved together one bore to the left, to the right, up, or down, as each lance performs its function on each bore.

At step 1114, the cleaning lance may be extended into the second bore. For example, the controller may control the first lance feeder to extend the first lance into the second bore. At step 1116, the examination lance may be extended into the first bore. For example, the controller may control the second lance feeder to extend the second lance into the first bore. In some embodiments, the controller may control each lance feeder individually to extend the cleaning lance and the examination lance into the bores. For example, the cleaning lance and the examination lance may be extended into the second and first bores, respectively, at the same time or at different times.

At step 1118, the first lance may clean the second bore. For example, the first lance may perform water jet cleaning on the second bore. At step 1120, the examination lance may examine the first bore. For example, the examination lance may collect and transmit video of the first bore or may perform non-destructive testing on the first bore. The examination lance may examine the first bore to determine if the cleaning performed by the first lance, and any other cleaning lances that performed functions on the first bore prior to the examination lance, sufficiently cleaned the first bore. The examination lance may also examine the first bore to determine if the first bore is structurally intact. After the second bore is cleaned and the first bore is examined, the first lance may be retracted and moved to a third bore, and the second lance may be retracted and moved to the second bore. Thus, multiple cleaning and/or examination steps may be automatically, or semi automatically, performed on bores of a heat exchanger. In some embodiments, multiple cleaning lances may perform multiple sequential cleaning steps on each bore and multiple examination lances may perform multiple sequential examination steps on each bore.

Figure 12:
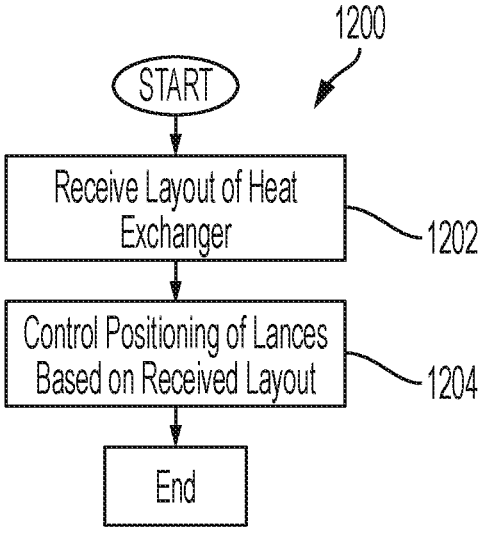
FIG. 12 is a flow chart of an example method for heat exchanger cleaning and examination based on a layout of the heat exchanger according to some embodiments of the disclosure.

A controller may control an indexer and one or more feeders based on a received bore layout of a heat exchanger. An example method 1200 for controlling a heat exchanger integrated service system based on a received layout of a heat exchanger is shown in FIG. 12. The method 1200 may begin, at step 1202, with receipt of a layout of a heat exchanger. The heat exchanger layout may, for example, include information such as a number of bores, positioning of the bores, a distance between the bores, a number of rows of bores, a number of bores per row of bores, coordinate positions of the bores, a roll angle, such as an offset measurement of the bore row plane with respect to the indexer plane, a diameter of the bores, a length of the bores, a pitch of the bores, and other information regarding the layout of the heat exchanger. At step 1204, the controller may control positioning of lances based on the received layout. For example, the controller may position each of the lances of the system a set distance apart based on a distance between centers of adjacent heat exchanger bores. Furthermore, once the controller has caused the indexer to position each lance at the entrance to each bore in a row or column of bores, the controller may cause the indexer to move the lances to the next row or column of bores. In some embodiments, the controller may assign xy coordinates or xyz coordinates to each bore of the heat exchanger and to each cleaning and examination lance, and may use the coordinates to control positioning of the cleaning and examination lances. Once each function has been performed on each bore, the controller may notify an operator that the maintenance and examination procedure is complete.

Figure 11:
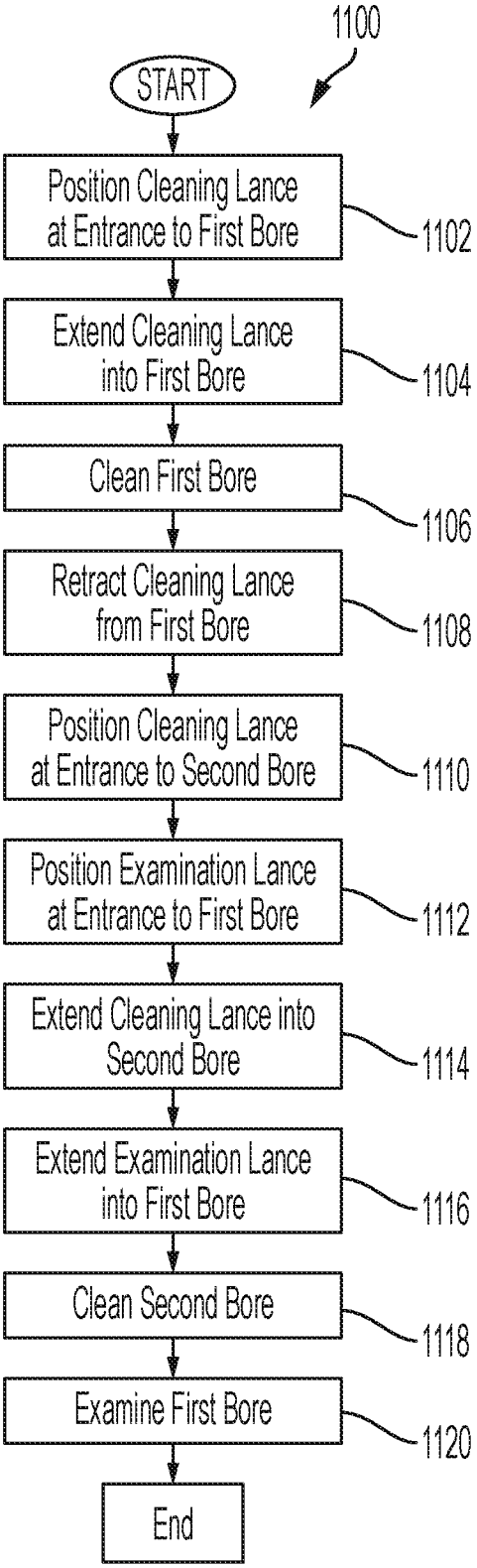
FIG. 11 is a flow chart of an example method for heat exchanger cleaning and examination according to some embodiments of the disclosure.

The schematic flow chart diagrams of FIGS. 11-12 are generally set forth as logical flow diagrams. As such, the depicted order and labeled steps are indicative of aspects of the disclosed method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagram, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

If implemented in firmware and/or software, functions described above may be stored as one or more instructions or code on a computer-readable medium. Examples include non-transitory computer-readable media encoded with a data structure and computer-readable media encoded with a computer program. Computer-readable media includes physical computer storage media. A storage medium may be any available medium that can be accessed by a computer. By way of example, and not limitation, such computer-readable media can comprise random access memory (RAM), read-only memory (ROM), electrically-erasable programmable read-only memory (EEPROM), compact disc read-only memory (CD-ROM) or other optical disk storage, magnetic disk storage or other magnetic storage devices, or any other medium that can be used to store desired program code in the form of instructions or data structures and that can be accessed by a computer. Disk and disc includes compact discs (CD), laser discs, optical discs, digital versatile discs (DVD), floppy disks and Blu-ray discs. Generally, disks reproduce data magnetically, and discs reproduce data optically. Combinations of the above should also be included within the scope of computer-readable media.

In addition to storage on computer readable medium, instructions and/or data may be provided as signals on transmission media included in a communication apparatus. For example, a communication apparatus may include a transceiver having signals indicative of instructions and data. The instructions and data are configured to cause one or more processors to implement the functions outlined in the claims.

Although the present disclosure and certain representative advantages have been described in detail, it should be understood that various changes, substitutions and alterations can be made herein without departing from the spirit and scope of the disclosure as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the present disclosure, processes, machines, manufacture, compositions of matter, means, methods, or steps, presently existing or later to be developed that perform substantially the same function or achieve substantially the same result as the corresponding embodiments described herein may be utilized. Accordingly, the appended claims are intended to include within their scope such processes, machines, manufacture, compositions of matter, means, methods, or steps.

What is claimed is:

1. An apparatus, comprising:

a cleaning lance configured to clean a plurality of bores of a heat exchanger;

an examination lance configured to examine the plurality of bores of the heat exchanger;

a first feeder configured to extend and contract a first lance, wherein the first lance is the cleaning lance;

a second feeder configured to extend and contract a second lance, wherein the second lance is the examination lance; and a controller configured to perform steps comprising:

controlling the first feeder to extend the cleaning lance into a first bore of the plurality of bores;

controlling the cleaning lance to clean the first bore;

controlling the first feeder to retract the cleaning lance from the first bore;

controlling the second feeder to extend the examination lance into the first bore;

controlling the examination lance to examine the first bore;

controlling the second feeder to retract the examination lance from the first bore.

2. The apparatus of claim 1, further comprising a first pump connected to the cleaning lance to pump a fluid through the cleaning lance, wherein controlling the cleaning lance to clean the first bore comprises:

controlling the first pump to pump fluid through the cleaning lance.

3. The apparatus of claim 2, further comprising:

a first safety valve coupled between the first pump and the cleaning lance, wherein the controller is further configured to perform steps comprising:

opening the first safety valve after the cleaning lance is extended into the first bore.

4. The apparatus of claim 1, further comprising an indexer configured to position the cleaning lance and the examination lance at a plurality of entrances of the plurality of bores, wherein the controller is further configured to perform steps comprising:

controlling the indexer to position the cleaning lance at the entrance to the first bore of the plurality of bores; and controlling the indexer to position the examination lance at the entrance to the first bore of the plurality of bores.

5. The apparatus of claim 4, wherein the controller is further configured to perform steps comprising:

receiving a layout of the heat exchanger, wherein the controller is further configured to control the indexer to position the cleaning lance and the examination lance based, at least in part, on the received layout of the heat exchanger.

6. The apparatus of claim 4, wherein the controller is further configured to perform steps comprising:

controlling the indexer to position the cleaning lance at an entrance to a second bore of the plurality of bores before controlling the indexer to position the examination lance at the entrance to the first bore of the plurality of bores;

controlling the cleaning lance to clean the second bore while controlling the examination lance to examine the first bore.

7. The apparatus of claim 1, further comprising a vision system coupled to the controller, wherein the vision system is configured to provide feedback to the controller to assist in aligning the cleaning lance and the first bore.

8. The apparatus of claim 1, wherein the first feeder comprises a first sensor configured to sense at least one of a travel distance or a travel speed of the cleaning lance, wherein the controller is further configured to perform steps comprising receiving, from the first sensor, at least one of the travel distance or the travel speed of the cleaning lance, wherein the controller is further configured to perform the steps of controlling the first feeder to extend and retract the cleaning lance based, at least in part, on the received travel distance or travel speed.

9. A method, comprising:

controlling, by a controller, an indexer to position a cleaning lance at an entrance to a first bore of a plurality of bores of a heat exchanger;

controlling, by the controller, a first feeder coupled to the cleaning lance to extend the cleaning lance into the first bore of the plurality of bores;

controlling, by the controller, the cleaning lance to clean the first bore of the plurality of bores;

controlling, by the controller, the first feeder to retract the cleaning lance from the first bore of the plurality of bores;

controlling, by the controller, the indexer to position an examination lance at the entrance to the first bore of the plurality of bores;

controlling, by the controller, a second feeder coupled to the examination lance to extend the examination lance into the first bore of the plurality of bores;

controlling, by the controller, the examination lance to examine the first bore of the plurality of bores; and controlling, by the controller, the second feeder to retract the examination lance from the first bore of the plurality of bores.

10. The method of claim 9, further comprising:

controlling, by the controller, the indexer to position the cleaning lance at an entrance to a second bore of the plurality of bores before controlling the indexer to position the examination lance at the entrance to the first bore of the plurality of bores.

11. The method of claim 10, further comprising controlling, by the controller, the cleaning lance to clean the second bore of the plurality of bores, while controlling the examination lance to examine the first bore of the plurality of bores.

12. The method of claim 9, wherein controlling, by the controller, the cleaning lance to clean the first bore of the plurality of bores comprises controlling, by the controller, a first pump to pump fluid through the cleaning lance.

13. The method of claim 12, wherein controlling, by the controller, the cleaning lance to clean the first bore of the plurality of bores further comprises controlling a first safety valve coupled between the first pump and the cleaning lance to open to allow fluid to be pumped through the cleaning lance by the first pump.

14. The method of claim 9, further comprising:

receiving, by the controller, at least one of a travel distance or a travel speed of the cleaning lance from a sensor of the first feeder, wherein controlling, by the controller, the first feeder to extend and contract the cleaning lance is based, at least in part, on the received travel distance or travel speed.

15. An apparatus, comprising:

a processor; and a memory, wherein the processor is further configured to perform steps comprising:

controlling an indexer to position a cleaning lance at an entrance to a first bore of a plurality of bores of a heat exchanger;

controlling a first feeder coupled to the cleaning lance to extend the cleaning lance into the first bore of the plurality of bores;

controlling the cleaning lance to clean the first bore of the plurality of bores;

controlling the first feeder to retract the cleaning lance from the first bore of the plurality of bores;

controlling the indexer to position an examination lance at the entrance to the first bore of the plurality of bores;

controlling a second feeder coupled to the examination lance to extend the examination lance into the first bore of the plurality of bores;

controlling the examination lance to examine the first bore of the plurality of bores; and controlling the second feeder to retract the examination lance from the first bore of the plurality of bores.

16. The apparatus of claim 15, wherein the processor is further configured to perform steps comprising:

controlling the indexer to position the cleaning lance at an entrance to a second bore of the plurality of bores before controlling the indexer to position the examination lance at the entrance to the first bore of the plurality of bores.

17. The apparatus of claim 16, wherein the processor is further configured to perform steps comprising controlling the cleaning lance to clean the second bore of the plurality of bores, while controlling the examination lance to examine the first bore of the plurality of bores.

18. The apparatus of claim 15, wherein controlling the cleaning lance to clean the first bore of the plurality of bores comprises controlling a first pump to pump fluid through the cleaning lance.

19. The apparatus of claim 18, wherein controlling the cleaning lance to clean the first bore of the plurality of bores further comprises controlling a first safety valve coupled between the first pump and the cleaning lance to open to allow fluid to be pumped through the cleaning lance by the first pump.

20. The apparatus of claim 15, wherein the processor is further configured to perform steps comprising:

receiving at least one of a travel distance or a travel speed of the cleaning lance from a sensor of the first feeder, wherein controlling the first feeder to extend and contract the cleaning lance is based, at least in part, on the received travel distance or travel speed.

* * * * *